United States Patent [19]

Diethelm

[11] Patent Number: 4,789,027

[45] Date of Patent: Dec. 6, 1988

[54] RIBBED HEAT EXCHANGER

[75] Inventor: Roland Diethelm, Neftenbach, Switzerland

[73] Assignee: Sulzer Brothers Limited, Winterthur, Switzerland

[21] Appl. No.: 861,609

[22] Filed: May 9, 1986

[30] Foreign Application Priority Data

May 15, 1985 [CH] Switzerland ..... 02076/85

[51] Int. Cl.[4] ..... F28D 1/04; F28F 1/20; F28F 1/30

[52] U.S. Cl. ..... 165/151; 165/124; 165/181; 165/182; 165/903

[58] Field of Search ..... 165/151, 903, 181, 182, 165/124

[56] References Cited

U.S. PATENT DOCUMENTS

| | | | |
|---|---|---|---|
| 1,805,116 | 5/1931 | Trane | 165/182 |
| 2,032,065 | 2/1936 | Modine | 165/181 |
| 2,055,838 | 9/1936 | Fritzberg | 165/151 |
| 2,768,814 | 10/1956 | Frey et al. | 165/903 X |
| 2,808,237 | 10/1957 | Fosnes | 165/903 X |
| 2,983,483 | 5/1961 | Modine | 165/151 |
| 3,515,207 | 6/1970 | Lu | 165/151 |
| 3,645,330 | 2/1972 | Albright et al. | 165/151 |
| 3,687,194 | 8/1972 | Schöll | 165/181 |
| 3,902,551 | 9/1975 | Lim et al. | 165/151 X |
| 4,141,411 | 2/1979 | Kalnin et al. | 165/151 |
| 4,328,861 | 5/1982 | Cheong et al. | 165/151 |
| 4,428,419 | 1/1984 | Dubrovsky et al. | 165/151 |
| 4,465,128 | 8/1984 | Krekacs et al. | 165/151 |
| 4,592,420 | 6/1986 | Hughes | 165/151 |

FOREIGN PATENT DOCUMENTS

| | | | |
|---|---|---|---|
| 404547 | 8/1934 | Belgium . | |
| 0201665 | 11/1986 | European Pat. Off. | 165/151 |
| 330454 | 12/1920 | Fed. Rep. of Germany | 165/151 |
| 725124 | 7/1942 | Fed. Rep. of Germany | 165/182 |
| 2450232 | 5/1975 | Fed. Rep. of Germany | 165/151 |
| 2720189 | 6/1978 | Fed. Rep. of Germany . | |
| 47368 | 3/1937 | France | 165/903 |
| 2250088 | 5/1975 | France . | |
| 2350167 | 12/1977 | France . | |
| 2478806 | 9/1981 | France . | |
| 0059196 | 5/1981 | Japan | 165/151 |
| 0182092 | 10/1983 | Japan | 165/151 |
| 310032 | 12/1955 | Switzerland . | |
| 580917 | 9/1946 | United Kingdom . | |
| 735384 | 8/1955 | United Kingdom . | |
| 1038556 | 8/1966 | United Kingdom . | |

*Primary Examiner*—Albert W. Davis, Jr.
*Assistant Examiner*—John K. Ford
*Attorney, Agent, or Firm*—Kenyon & Kenyon

[57] ABSTRACT

The heat exchanger is formed of parallel rows of tubes and transverse ribs. The ribs have flat uncorrugated parts extending in zones about and along the rows of tubes as well as corrugated parts extending between the rows of tubes. The flat parts may be separated from the corrugated parts by stepped parts or fillers may be provided in the gaps between the uncorrugated parts. The gaps are to conduct a flow of medium in heat exchange relation to a flow of medium through the tubes. The crests and troughs of each corrugated part extend from the same plane adjacent a flat part and terminate in a similar plane at an adjacent flat part. Streamline-shaped inflow and outflow members aligned with the stepped part of the fin direct the flow of air.

4 Claims, 2 Drawing Sheets

RIBBED HEAT EXCHANGER

This invention relates to a heat exchanger. More particularly, this invention relates to a heat exchanger constructed of parallel tubes and transverse ribs.

Heretofore, various types of heat exchangers have been known for heat transfer between two flowing media. For example, German O.S. No. 2,305,056 describes a heat exchanger having a number of parallel tubes which carry a first medium and which are disposed in a number of parallel rows as well as a plurality of corrugated sheet metal ribs which are distributed over the length of the tubes in a transverse manner. In this construction, the ribs are in a heat-conductive relationship with the tubes and serve to define gaps between the ribs through which a second medium may flow. As described, the ribs are corrugated continuously and are provided with apertures, the purpose of which is to improve heat transfer from the ribs to the second medium by causing the second medium to eddy and to flow, to some extent, from one side of a rib to the other side. However, it has been found that the improvement of heat transfer is obtained only at the expense of relatively high pressure losses. Further, the corrugations which are present in the zone through which the tubes penetrate is a considerable hinderance in the production of the heat exchanger since the corrugations in this zone can be shaped only by means of complicated shaping tools in a number of working steps. In addition, the initial costs of the shaping tools are considerable.

Accordingly, it is an object of the invention to provide a heat exchanger having good heat exchange properties and which operates with a reduced pressure loss.

It is another object of the invention to provide a heat exchanger of relatively simply and inexpensive construction.

It is another object of the invention to improve on the construction of the heat exchanger formed of parallel tubes and transverse ribs.

Briefly, the invention provides a heat exchanger which is comprised of a plurality of parallel tubes for conveying a first medium and which are disposed in parallel rows as well as a plurality of sheet metal ribs which are distributed longitudinally and transversely of the tubes and which are in heat conductive relation with the tubes. In addition, the ribs are disposed in parallel relation to each other in order to define gaps for conveying a second medium therethrough. In accordance with the invention, each rib has an uncorrugated zone which extends around a respective row of the tubes as well as an uninterrupted corrugated part extending from each side of the uncorrugated zone.

Since the zone of the ribs through which the tubes penetrate are free from corrugations, the ribs are considerably simpler and cheaper to produce than continuously corrugated metal ribs of previously known heat exchangers. In addition, the shaping tools used to corrugate the ribs is less elaborate and helps to reduce costs.

Further, since the corrugated parts of the ribs are free of perforations, pressure losses for the second medium are considerably reduced as compared to previous constructions. In addition, reduced pressure losses lead to clearly visible flow patterns of the second medium which permit a better understanding of the theory behind physical events in the heat exchanger so that, in contrast to the known heat exchangers, a thermodynamic behavior of the heat exchanger can be calculated relatively easily.

Another advantage of the heat exchanger is that the absence of the apertures in the corrugations enhances the strength of the heat exchanger. Further, in the absence of apertures, it has been found that the heat exchange coefficient of the heat exchanger greatly exceeds that of the known heat exchanger for the reason that there are no apertures to distribute heat conduction in the ribs. Consequently, local build-ups of heat and the resulting thermal stressing are eliminated.

In order to enhance the production of the ribs, the crests of each corrugated part extend at a right angle to the plane containing the longitudinal axis of each tube of an adjacent row of tubes.

The ribs may also be shaped in order to provide for very low pressure losses. To this end, each rib is provided with a stepped part joining a corrugated part to the uncorrugated zone so that the corrugated part is in a spaced parallel plane to the uncorrugated zone. Because of the stepped part, the second medium does not flow through the rib zone where the tubes penetrate.

In order to facilitate production of the heat exchanger, the uncorrugated zone of each rib is provided with a necked-out collar which is secured to and about a respective tube.

In one alternative embodiment, instead of using stepped parts between the corrugated part and uncorrugated zone, a filling agent may be disposed in the gaps between the ribs within the zones in which the tubes penetrate the ribs. In this case, the rib construction is relatively simple.

In order to enhance the flow conditions, a streamline-shaped member may be disposed on at least one of the inflow side and the outflow side of a respective uncorrugated zone in order to direct a flow of a second medium over or from the corrugated parts of the ribs.

These and other objects and advantages of the invention will become more apparent from the following detailed description taken in conjunction with the accompanying drawings wherein.

Figure 1:
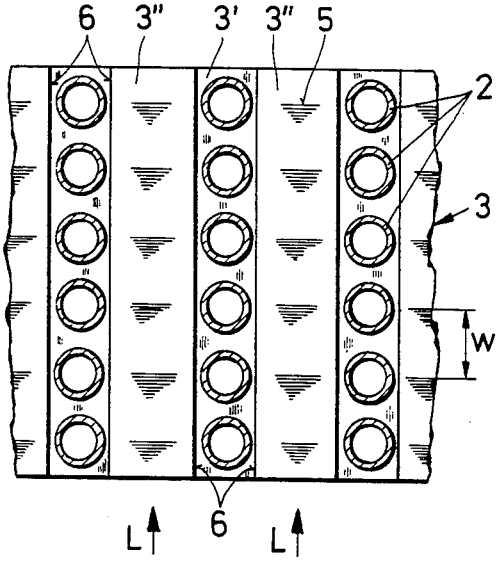
FIG. 1 illustrates a cross sectional view through a portion of a heat exchanger constructed in accordance with the invention.
Figure 2:
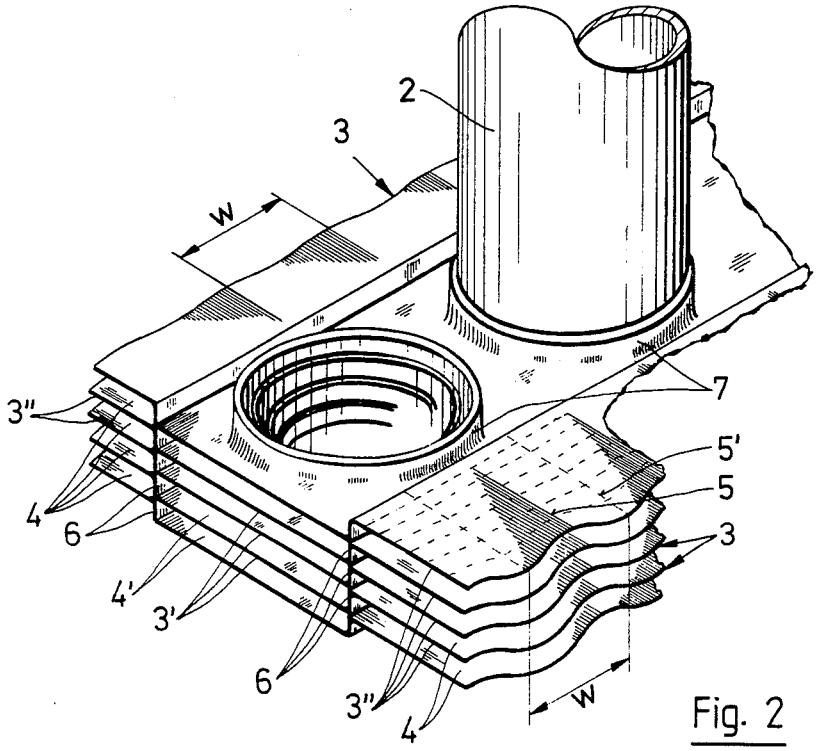
FIG. 2 illustrates a diagrammatic perspective view of a part of the heat exchanger of FIG. 1.

Referring to FIGS. 1 and 2, the heat exchanger is constructed of a plurality of horizontally disposed parallel straight tubes 2 which are disposed vertically one above another in a plurality of parallel rows for carrying a first medium, such as hot water. In addition, the tubes 2 are interconnected by way of a plurality of ribs 3 which are distributed longitudinally of the tubes 2 in heat conductive relation. The ribs 3 are made of sheet metal and are disposed in parallel relation to each other in order to define gaps for conveying a second medium, such as cooling air, as indicated by the arrows L in the direction of the tube rows.

Referring to FIG. 2, each rib 3 has a flat uncorrugated part 3' disposed in a zone where a row of tubes 2 extend through as well as corrugated parts 3" which extend from opposite sides of an uncorrugated part 3'. In addition, each rib 3 has a stepped part 6 joining a respective corrugated part 3" to the uncorrugated flat part 3' such that each corrugated part 3" is in a spaced parallel plane to the uncorrugated part 3'. As indicated in FIG. 2, each corrugated part 3" is directly contiguous to an uncorrugated part 3'.

Each uncorrugated part 3' is also provided with a plurality of necked-collars 7, each of which is secured to and about a respective tube 2. For example, after the heat exchanger has been assembled, each collar 7 may be connected by welding to a respective tube 2 in a heat-conductive relation.

The corrugated parts 3" of each rib 3 are so shaped that corrugations of a constant length w are contiguous with one another as considered in the direction of flow of the second medium. In addition, the crests 5 of the corrugations form a straight line starting in FIG. 2 from the top edge of a stepped part 6. The crests 5 are coplanar and extend perpendicularly to a plane containing the longitudinal axis of each tube 2 of an adjacent row of tubes 2. The corrugation troughs 5' disposed between the crests 5 also start from the top edge of a stepped part 6 and after the arcuate transition extend substantially parallel to the crests 5. Approximately one half of the corrugated parts 3" is shown in the foreground of FIG. 2. The other half which is not shown is of symmetrical construction and terminates at the top edge of the corresponding stepped part of the adjacent tube row.

All of the ribs 3 are identical to one another and to assemble the heat exchanger are pushed on to the tubes 2, then pushed together until the stepped parts 6 contact one another. Since all the parts 6 are of the same height, gaps 4 are present between any two adjacent ribs 3 in the corrugated parts thereof while gaps 4' are present between the uncorrugated plane parts 3'. The distance between the corrugations of two adjacent rib parts 3" is therefore constant.

The ribs 3 with the corrugations, the stepped parts 6 and the collars 7 are produced in a single working step from flat metal strip by means of an appropriate shaping tool.

When the heat exchanger is in operation, the cooling air flows in the gaps 4, 4' and the hot water to be cooled flows transversely to the air in the tubes 2. The heat from the hot water is distributed over the walls of the tubes 2 into the ribs 3 and propagates rectilinearly therein without building up. Because of the lack of perforations, there is virtually no eddying of the cooling air in the gaps 4 between the corrugated parts 3". Consequently, air pressure losses in the cooling air are caused substantially only by friction and therefore very reduced. The repeated changes in direction of the through-flowing air at the corrugations of the parts 3" lead to minor pressure variations which continuously break up the envolving boundary layer, thus ensuring satisfactory heat exchange in the corrugated gaps 4.

The gaps 4' between the plane rib parts 3' are relatively small and cause only a reduced total pressure loss. The stepped parts 6 separate the gaps 4' effectively from the corrugated gaps 4.

Figure 3:
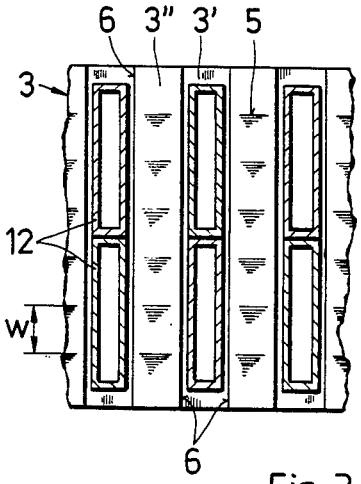
FIG. 3 illustrates a cross sectional view through an alternative embodiment of the heat exchanger constructed in accordance with the invention.

Referring to FIG. 3 wherein like reference characters indicate like parts as above, the heat exchanger may also be constructed with straight tubes 12 of rectangular cross-section which contact one another in a row and through which hot water to be cooled flows. Consequently, pressure losses in the gaps between the plane rib parts 3' are even less than in the embodiment of FIGS. 1 and 2. Another advantage provided by the shape of the tubes 12 is that the distance between their longitudinal sides and the adjacent corrugated rib part 3" is less than in the embodiment of FIGS. 1 and 2, with a consequent improvement in heat exchange conditions. The thermodynamic advantages of the heat exchanger of FIG. 3 will be apparent from a comparison thereof with FIG. 1 since the two heat exchangers have the same heat performance and are drawn to the same scale —i.e., the heat exchanger of FIG. 3 is considerably more compact than the heat exchanger of FIG. 1.

Figure 4:
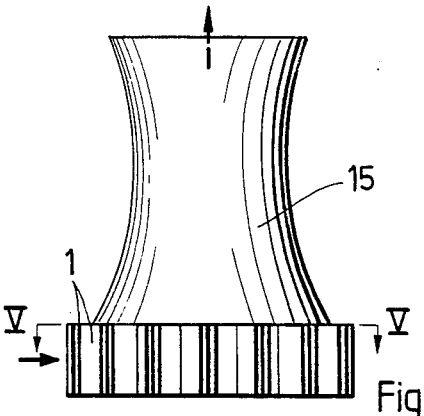
FIG. 4 illustrates a diagramatic view of a cooling tower having heat exchangers according to the invention disposed in a bottom part.
Figure 5:
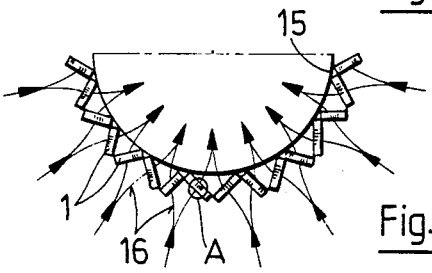
FIG. 5 illustrates a view taken on line V—V of FIG. 4 through one half of the cooling tower.
Figure 6:
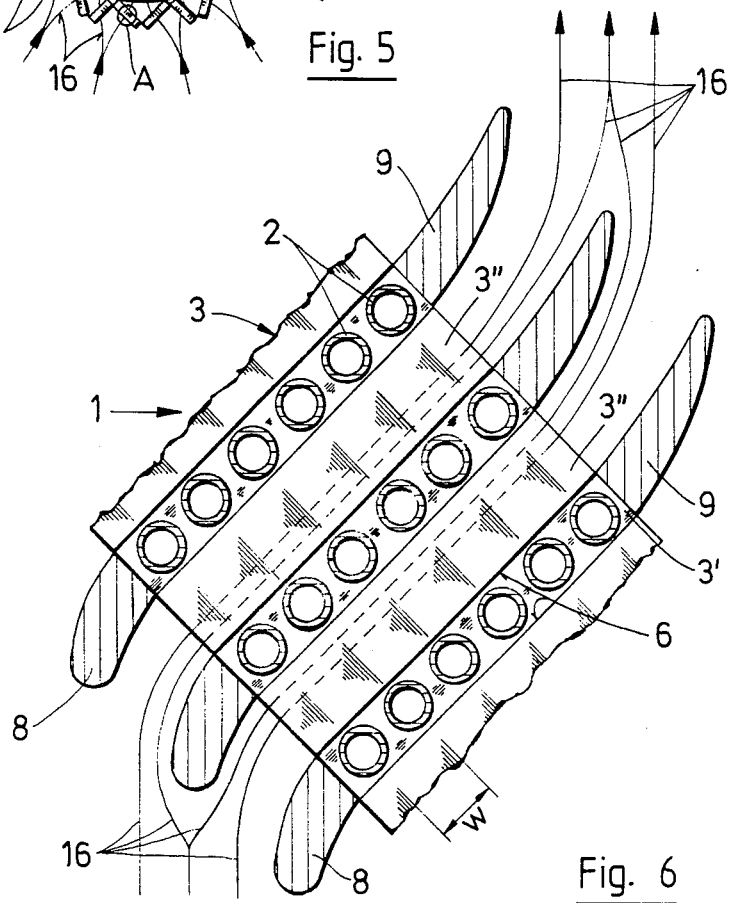
FIG. 6 illustrates a view in section of a detail A of FIG. 5.

Referring to FIGS. 4, 5 and 6, a hyperbolic cooling tower 15 has a vertical annular air entry in a bottom part and a horizontal circular air outlet in a top part. Thirty-two heat exchangers 1 of the kind shown in FIGS. 1 and 2 are arranged delta-fashion around the cooling tower air inlet. Hot water for cooling, for example, from a power station, flows through the tubes 2 of the heat exchangers so that cooling air entering the tower 15 is heated.

Referring to FIG. 6, each heat exchanger 1 has a streamline-shaped inflow member 8 and a similar outflow member 9 in the zone of the gaps 4' in alignment with a row of tubes 2. The members 8, 9, which enhance the flow profile of the cooling air (arrows 16), are arranged with their boundary surfaces in alignment with the stepped parts 6.

Figure 7:
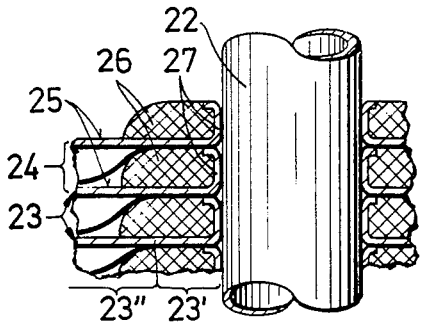
FIG. 7 illustrates a longitudinal sectional view through another embodiment of the heat exchanger constructed in accordance with the invention.

Referring to FIG. 7, the heat exchanger may also be constructed with vertical tubes 22 which carry a first medium and are disposed in rows, only one tube 22 being shown in FIG. 7. In this case, horizontal sheet-metal ribs 23 which are also parallel to one another extend about and from the tubes 22 in heat-conductive relation. The ribs 23 bound gaps 24 through which a second medium flows perpendicularly to the plane of the illustration. The ribs 23 have corrugated parts 23" and on either side thereof plane parts 23' which merge directly into one another without stepped parts. Instead, the crests 25 of the corrugated parts 23" are coplanar with the plane parts 23'. Collars 27 in the plane parts 23' each engage around a tube 22 and also determine the distance between adjacent ribs 23.

The gaps between the plane parts 23' and some of the immediately contiguous gaps 24—i.e., the transition zone between the plane and the corrugated parts—are filled with fillers 26 which extend, as considered perpendicularly to the plane of the illustration, along the entire depth of the heat exchanger. The fillers 26 can be made of various materials, such as rubber or plastics or epoxy or cast aluminum, and each tube row can be produced in one or more parts.

The embodiment of FIG. 7 has several advantages. First, the heat exchanger is easy to produce. Second, the second medium is kept entirely away from the gaps through which the tubes 22 extend and from the narrow transition zones to the corrugated parts 23" where there is a relatively small amount of corrugated surface available for heat transfer. Consequently, heat exchange between the ribs 23 and the second medium takes place exclusively in the flow-enhancing corrugated zone. Third, the fillers 26 are a simple means of improving the strength of the heat exchanger and obviate the need for a rigid connection between the tubes 22 and the collars 27. Fourth, the flow pattern hereinbefore described also helps to considerably reduce the risk of corrosion.

The use of inflow members 8 and outflow members 9 as in FIG. 6 is very effective in the case of the heat exchanger of FIG. 7.

As a variant of the embodiments described, the between-ribs distance can be varied, for example, the height of the discrete ribs and the corrugation length w need not necessarily be constant. The nature of the transition from the plane zone to the corrugated zone can be other than described. For instance, the corrugated parts can be welded or adhered to the stepped parts. The stepped parts need extend neither planarly or vertically. The tubes can extend horizontally or at an inclination and need not be straight.

It is not essential for the ribs to be plane in the zone where the tubes extend through and the longitudinal axes of the tubes can be at an inclination to the ribs. Also, a matrix other than rectangular can be provided in section transversely to the longitudinal axes of the tubes.

The tubes need not necessarily be circular or rectangular in cross-section and can be, for instance, of oval cross-section or of a cross-section varying along the tube longitudinal axis. Because of special support surfaces in connection with strength and/or heat technology, it may be possible to use tubes and/or ribs of varying wall thickness in a single heat exchanger. If necessary, the collars 7, 27 can be welded together sealingly, for instance, by brazing, so as to form the tubes themselves.

The invention thus provides a heat exchanger of relatively simple construction which can be economically fabricated from rows of parallel tubes and sheet-metal ribs.

I claim:

1. A heat exchanger comprising a plurality of parallel tubes for conveying a first medium disposed in parallel rows;

a plurality of sheet metal ribs distributed longitudinally and transversely of said tubes and in heat conductive relation therewith, said ribs being disposed in parallel relation to each other to define gaps for conveying a second medium therethrough, each rib having a flat zone extending around and at a right angle to a respective row of said tubes, an uninterrupted corrugated part extending from each side of said zone and a stepped part joining a respective corrugated part to said zone with said respective corrugated part in a spaced parallel plane to said zone; and a streamline-shaped member disposed on at least one of an inflow side and an outflow side of a respective zone for directing a flow of the second medium over or from said corrugated parts of said ribs, said member having boundary surfaces thereof in alignment with said stepped part of a respective rib.

2. A heat exchanger as set forth in claim 1 wherein each corrugated part has a plurality of coplanar crests extending at a right angle to a plane containing a longitudinal axis of each tube of an adjacent row of tubes.

3. A heat exchanger as set forth in claim 1 wherein each corrugated part has corrugations of equal length to the corrugations of the remaining corrugated parts.

4. A heat exchanger as set forth in claim 1 wherein each flat zone has a necked-out collar secured to and about a respective tube

* * * * *

UNITED STATES PATENT AND TRADEMARK OFFICE

CERTIFICATE OF CORRECTION

PATENT NO. : 4,789,027

DATED : Dec. 6, 1988

INVENTOR(S) : Roland Diethelm

It is certified that error appears in the above-identified patent and that said Letters Patent is hereby corrected as shown below:

Column 1, line 36 "simply" should be -simple-

Signed and Sealed this

Fifth Day of September, 1989

*Attest:*

*Attesting Officer*

DONALD J. QUIGG

*Commissioner of Patents and Trademarks*